US010120297B2

(12) United States Patent
Yamada et al.

(10) Patent No.: US 10,120,297 B2
(45) Date of Patent: Nov. 6, 2018

(54) LIQUID DEVELOPER

(71) Applicant: Kao Corporation, Chuo-ku (JP)

(72) Inventors: Tatsuya Yamada, Wakayama (JP); Nobumichi Kamiyoshi, Wakayama (JP)

(73) Assignee: Kao Corporation, Chuo-ku (JP)

( * ) Notice: Subject to any disclaimer, the term of this patent is extended or adjusted under 35 U.S.C. 154(b) by 0 days.

(21) Appl. No.: 15/735,751

(22) PCT Filed: May 24, 2016

(86) PCT No.: PCT/JP2016/065273
§ 371 (c)(1),
(2) Date: Dec. 12, 2017

(87) PCT Pub. No.: WO2016/208308
PCT Pub. Date: Dec. 29, 2016

(65) Prior Publication Data

US 2018/0181016 A1 Jun. 28, 2018

(30) Foreign Application Priority Data

Jun. 25, 2015 (JP) ..... 2015-127890

(51) Int. Cl.
*G03G 9/13* (2006.01)
*G03G 9/08* (2006.01)
*G03G 9/125* (2006.01)

(52) U.S. Cl.
CPC ..... *G03G 9/132* (2013.01); *G03G 9/081* (2013.01); *G03G 9/125* (2013.01); *G03G 9/131* (2013.01)

(58) Field of Classification Search
CPC ..... G03G 9/135; G03G 9/131; G03G 9/133
See application file for complete search history.

(56) References Cited

U.S. PATENT DOCUMENTS

2013/0216945 A1* 8/2013 Konno ..... C08L 33/14 430/105
2015/0268579 A1* 9/2015 Soneta ..... C08F 220/18 430/18
2016/0085170 A1 3/2016 Momotani et al.
2016/0282743 A1 9/2016 Kamiyoshi et al.

FOREIGN PATENT DOCUMENTS

EP 2749954 * 7/2014 ..... G03G 9/15
JP 2008-170702 A 7/2008
JP 2013-130791 A 7/2013
JP 2014-92579 A 5/2014
JP 2014-132324 A 7/2014
JP 2015-145985 A 8/2015
JP 2016-62018 A 4/2016
JP 2016-184156 A 10/2016

OTHER PUBLICATIONS

International Search Report dated Jul. 12, 2016 in PCT/JP2016/065273, citing documents AO through AR therein, 2 pages.
International Search Report dated Jul. 12, 2016 in PCT/JP2016/065273, 2 pages.

* cited by examiner

*Primary Examiner* — Hoa V Le
(74) *Attorney, Agent, or Firm* — Oblon, McClelland, Maier & Neustadt, L.L.P.

(57) ABSTRACT

A liquid developer containing toner particles containing a resin binder and a pigment, wherein the toner particles are dispersed in an insulating liquid in the presence of a dispersant, wherein the resin binder contains a polyester resin P having a glass transition temperature of 35° C. or higher, obtained by polycondensing raw material monomers containing an alcohol component comprising an aliphatic diol having 2 or more carbon atoms and 6 or less carbon atoms in an amount of 70% by mol or more and 100% by mol or less, and a carboxylic acid component, and wherein the dispersant contains a copolymer C prepared by polymerizing a monomer A having an amino group and a monomer B represented by the formula (I):

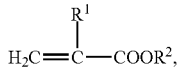

(I)

wherein $R^1$ is a hydrogen atom or a methyl group; and $R^2$ is an alkyl group having 1 or more carbon atoms and 22 or less carbon atoms or an alkenyl group having 2 or more carbon atoms and 22 or less carbon atoms, each of which may have a substituent, wherein a molar ratio of the monomer A to the monomer B (monomer A/monomer B) is 2/98 or more and 50/50 or less; and a method for producing the same. The liquid developer of the present invention is suitably used in development or the like of latent images formed in electrophotography, electrostatic recording method, electrostatic printing method or the like.

16 Claims, No Drawings

LIQUID DEVELOPER

FIELD OF THE INVENTION

The present invention relates to a liquid developer usable in development of latent images formed in electrophotography, electrostatic recording method, electrostatic printing method or the like, and a method for producing the same.

BACKGROUND OF THE INVENTION

Electrophotographic developers are a dry developer in which toner components composed of materials containing a colorant and a resin binder are used in a dry state, and a liquid developer in which toner components are dispersed in an insulating carrier liquid.

Since the demands for speeding up liquid developers have been more increasing, the liquid developers have also been desired to have lowered viscosities. In other words, liquid developers in which toner particles are stably dispersed in smaller particle sizes and lowered viscosities have been desired. In addition, in order to speed up, a toner which is melt-fusible in a smaller heating unit, i.e. a toner having excellent low-temperature fusing ability has been desired.

Patent Publication 1 discloses a liquid developer containing a polymeric dispersant prepared by polymerizing an ethylenically unsaturated monomer having an amino group, and an ethylenically unsaturated monomer containing an alkyl group having from 4 to 24 carbon atoms, and a plasticizer, for the purposes of obtaining excellent fusing ability, offset resistance, color developing ability, and color reproducibility, and stable optical density.

Patent Publication 2 discloses a liquid developer containing a polymeric dispersant prepared by polymerizing an ethylenically unsaturated monomer having an amino group, and an ethylenically unsaturated monomer containing an alkyl group having from 9 to 24 carbon atoms, for the purposes of obtaining excellent color developing ability and color reproducibility, and stable dispersion state and optical density of the toner particles.

Patent Publication 1: Japanese Patent Laid-Open No. 2014-092579

Patent Publication 2: Japanese Patent Laid-Open No. 2014-132324

SUMMARY OF THE INVENTION

The present invention relates to:

[1] a liquid developer containing toner particles containing a resin binder and a pigment, wherein the toner particles are dispersed in an insulating liquid in the presence of a dispersant, wherein the above resin binder contains a polyester resin P having a glass transition temperature of 35° C. or higher, obtained by polycondensing raw material monomers containing an alcohol component containing an aliphatic diol having 2 or more carbon atoms and 6 or less carbon atoms in an amount of 70% by mol or more and 100% by mol or less, and a carboxylic acid component, and wherein the above dispersant contains a copolymer C prepared by polymerizing a monomer A having an amino group and a monomer B represented by the formula (I):

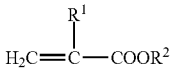

(I)

wherein $R^1$ is a hydrogen atom or a methyl group; and $R^2$ is an alkyl group having 1 or more carbon atoms and 22 or less carbon atoms or an alkenyl group having 2 or more carbon atoms and 22 or less carbon atoms, each of which may have a substituent, wherein a molar ratio of the monomer A to the monomer B (monomer A/monomer B) is 2/98 or more and 50/50 or less, and a molar ratio of a monomer B1 in which $R^2$ in the monomer B is an alkyl group having 1 or more carbon atoms and 9 or less carbon atoms or an alkenyl group having 2 or more carbon atoms and 9 or less carbon atoms to a monomer B2 in which $R^2$ in the monomer B is an alkyl group or alkenyl group having 10 or more carbon atoms and 22 or less carbon atoms (monomer B 1/monomer B2) is 0 or more and 0.1 or less; and

[2] a method for producing a liquid developer, including:

step 1: melt-kneading at least a resin binder and a pigment, and pulverizing a kneaded product obtained, to provide toner particles; and step 2: dispersing toner particles obtained in the step 1 in an insulating liquid in the presence of a dispersant, wherein the above resin binder contains a polyester resin P having a glass transition temperature of 35° C. or higher, obtained by polycondensing raw material monomers containing an alcohol component containing an aliphatic diol having 2 or more carbon atoms and 6 or less carbon atoms in an amount of 70% by mol or more and 100% by mol or less, and a carboxylic acid component, and wherein the above dispersant contains a copolymer C prepared by polymerizing a monomer A having an amino group and a monomer B represented by the formula (I):

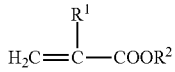

(I)

wherein $R^1$ is a hydrogen atom or a methyl group; and $R^2$ is an alkyl group having 1 or more carbon atoms and 22 or less carbon atoms or an alkenyl group having 2 or more carbon atoms and 22 or less carbon atoms, each of which may have a substituent, wherein a molar ratio of the monomer A to the monomer B (monomer A/monomer B) is 2/98 or more and 50/50 or less, and a molar ratio of a monomer B1 in which $R^2$ in the monomer B is an alkyl group having 1 or more carbon atoms and 9 or less carbon atoms or an alkenyl group having 2 or more carbon atoms and 9 or less carbon atoms to a monomer B2 in which $R^2$ in the monomer B is an alkyl group or alkenyl group having 10 or more carbon atoms and 22 or less carbon atoms (monomer B1/monomer B2) is 0 or more and 0.10 or less.

DETAILED DESCRIPTION OF THE INVENTION

However, in liquid developers described in Patent Publications 1 and 2, a resin binder is likely to partly elute into an insulating liquid, so that filming is caused on a developer roller or the like in a printer, thereby undesirably causing disruption in the fused images. In addition, in the conventional techniques, it is difficult to control elution of a resin binder and filming caused thereby, while securing excellent storage stability and low-temperature fusing ability.

The present invention relates to a liquid developer having a smaller particle size, a lowered viscosity, and excellent storage stability and low-temperature fusing ability, while controlling elution of a resin binder into an insulating liquid, and a method for producing a liquid developer.

The liquid developer of the present invention exhibits some effects of having a smaller particle size, a lowered viscosity, and excellent storage stability and low-temperature fusing ability, while controlling elution of a resin binder into an insulating liquid.

One of the features of the liquid developer of the present invention is a liquid developer containing toner particles containing a resin binder and a pigment, wherein the toner particles are dispersed in an insulating liquid in the presence of a dispersant, wherein the above resin binder contains a polyester resin P obtained by polycondensing raw material monomers containing an alcohol component containing an aliphatic diol having 2 or more carbon atoms and 6 or less carbon atoms, and a carboxylic acid component, and wherein the above dispersant contains a copolymer C prepared by polymerizing a monomer A having an amino group and a monomer B represented by the formula (I):

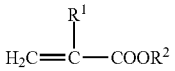

(I)

wherein $R^1$ is a hydrogen atom or a methyl group; and $R^2$ is an alkyl group having 1 or more carbon atoms and 22 or less carbon atoms or an alkenyl group having 2 or more carbon atoms and 22 or less carbon atoms, each of which may have a substituent, in a molar ratio (monomer A/monomer B) of 2/98 or more and 50/50 or less, and the liquid developer has a smaller particle size, a lowered viscosity, and excellent storage stability and low-temperature fusing ability, while controlling elution of a resin binder into an insulating liquid.

Although the reasons why such effects are exhibited are not certain, they are considered to be as follows.

A copolymer C having a molar ratio of a monomer A to a monomer B as defined above has a high affinity to a nonpolar insulating liquid, so that the copolymer has a high dispersibility, is more likely to have a lowered viscosity, and has excellent storage stability. Further, when the copolymer C adsorbs to toner particles, a toner surface is modified, so that penetration of an insulating liquid into toner particles is more likely to be accelerated. By the acceleration, it is considered that plasticization of the toner particles takes place, thereby making them excellent in low-temperature fusing ability.

In addition, it is considered that since a monomer B1 having a shorter hydrocarbon chain is reduced, a steric repulsive force by a dispersant adsorbed to a toner is increased, so that aggregation or thickening can be controlled, which makes it likely to have a lowered viscosity, thereby improving storage stability and low-temperature fusing ability. Further, by the use of a highly polar polyester resin P richly containing an aliphatic diol having 2 or more carbon atoms and 6 or less carbon atoms as a resin binder in the toner, it is considered that excessive plasticization is prevented, so that elution of a resin binder into an insulating liquid can be controlled. By controlling the elution, filming on a developer roller or the like within a printer can be controlled.

Further, a copolymer C quickly adsorbs to toner particles to bring about steric repulsive effects, so that it is considered that reaggregation of the particles is controlled, which makes it effective in forming smaller particles.

The resin binder of the liquid developer of the present invention contains a polyester resin P obtained by polycondensing raw material monomers containing an alcohol component containing an aliphatic diol having 2 or more carbon atoms and 6 or less carbon atoms in an amount of 70% by mol or more and 100% by mol or less and a carboxylic acid component.

The aliphatic diol having 2 or more carbon atoms and 6 or less carbon atoms includes ethylene glycol, 1,2-propanediol, 1,3-propanediol, 1,2-butanediol, 1,3-butanediol, 1,4-butanediol, 2,3-butanediol, 1,2-pentanediol, 1,3-pentanediol, 1,4-pentanediol, 1,5-pentanediol, 2,3-pentanediol, 2,4-pentanediol, 1,2-hexanediol, 1,3-hexanediol, 1,4-hexanediol, 1,5-hexanediol, 1,6-hexanediol, 2,3-hexanediol, 3,4-hexanediol, 2,4-hexanediol, 2,5-hexanediol, 1,4-butenediol, neopentyl glycol, and the like. The aliphatic diol selected from these aliphatic diols is preferably used alone or in two or more kinds.

The aliphatic diol has the number of carbon atoms of 2 or more, and preferably 3 or more, from the viewpoint of improving low-temperature fusing ability of the toner, and the aliphatic diol has the number of carbon atoms of 6 or less, and preferably 4 or less, from the viewpoint of lowered viscosity, pulverizability, and low-temperature fusing ability.

It is preferable that the aliphatic diol is an aliphatic diol having a hydroxyl group bonded to a secondary carbon atom, from the viewpoint of improving lowered viscosity, pulverizability, and low-temperature fusing ability of the toner. Specific examples include 1,2-propanediol, 1,2-butanediol, 1,3-butanediol, 2,3-butanediol, 1,2-pentanediol, 1,3-pentanediol, 2,3-pentanediol, 2,4-pentanediol, and the like, and 1,2-propanediol and 2,3-butanediol are preferred, and 1,2-propanediol is more preferred. The aliphatic diol selected from these aliphatic diols is preferably used alone or in two or more kinds.

The content of the aliphatic diol having 2 or more carbon atoms and 6 or less carbon atoms is 70% by mol or more, preferably 80% by mol or more, more preferably 90% by mol or more, even more preferably 95% by mol or more, and even more preferably 99% by mol or more, and 100% by mol or less, and preferably 100% by mol, of the alcohol component, from the viewpoint of controlling elution of the resin.

The content of the aliphatic diol having a hydroxyl group bonded to a secondary carbon atom is preferably 80% by mol or more, more preferably 90% by mol or more, and even more preferably 95% by mol or more, and preferably 100% by mol or less, and more preferably 100% by mol, of the alcohol component, from the viewpoint of controlling elution of the resin.

Other alcohol components include aromatic diols such as alkylene oxide adducts of bisphenol A, alicyclic diols, trihydric or higher polyhydric alcohols such as glycerol, and the like.

It is preferable that the carboxylic acid component contains an aromatic dicarboxylic acid compound, from the viewpoint of lowered viscosity, pulverizability, and low-temperature fusing ability.

The aromatic dicarboxylic acid compound includes phthalic acid, isophthalic acid, terephthalic acid, acid anhydrides thereof, alkyl (1 or more carbon atoms and 3 or less carbon atoms) esters thereof, and the like. Here, the dicarboxylic acid compound refers to a dicarboxylic acid, an ester formed between a carboxylic acid and an alcohol having 1 or more carbon atoms and 3 or less carbon atoms, and an acid anhydride thereof.

The content of the aromatic dicarboxylic acid compound is preferably 50% by mol or more, more preferably 80% by mol or more, even more preferably 90% by mol or more, and even more preferably 95% by mol or more, and preferably 100% by mol or less, more preferably substantially 100% by mol, and even more preferably 100% by mol, of the carboxylic acid component, from the viewpoint of lowered viscosity, pulverizability, and low-temperature fusing ability.

In addition, a tricarboxylic or higher polycarboxylic acid compound may be contained, from the viewpoint of improving high-temperature offset resistance, durability, and heat-resistant storage property of the toner.

The tricarboxylic or higher polycarboxylic acid compound includes 1,2,4-benzenetricarboxylic acid (trimellitic acid), 2,5,7-naphthalenetricarboxylic acid, 1,2,4,5-benzenetetracarboxylic acid (pyromellitic acid), and the like. From the viewpoint of improving high-temperature offset resistance, durability, and heat-resistance storage property of the toner, 1,2,4-benzenetricarboxylic acid (trimellitic acid) and an acid anhydride thereof are preferred, and an anhydride of 1,2,4-benzenetricarboxylic acid (trimellitic anhydride) is more preferred.

The content of the tricarboxylic or higher polycarboxylic acid compound is preferably 30% by mol or less, more preferably 10% by mol or less, even more preferably 5% by mol or less, and even more preferably 1% by mol or less, and preferably 0% by mol or more, and preferably 0% by mol, from the viewpoint of improving low-temperature fusing ability of the toner.

Other carboxylic acid components include aliphatic dicarboxylic acids such as oxalic acid, malonic acid, maleic acid, fumaric acid, succinic acid, adipic acid, sebacic acid, azelaic acid, succinic acid substituted with an alkyl group having 1 or more carbon atoms and 20 or less carbon atoms or an alkenyl group having 2 or more carbon atoms and 20 or less carbon atoms, alicyclic dicarboxylic acids such as cyclohexanedicarboxylic acid; rosins such as unpurified rosins and purified rosins; rosins modified with fumaric acid, maleic acid, or acrylic acid, acid anhydrides thereof, alkyl(1 or more carbon atoms and 3 or less carbon atoms) esters thereof, and the like.

Here, the alcohol component may contain a monohydric alcohol, and the carboxylic acid component may contain a monocarboxylic acid compound in proper amounts, from the viewpoint of adjusting a softening point of a polyester resin P.

The equivalent ratio of the carboxylic acid component to the alcohol component in the polyester resin P, i.e. COOH group or groups/OH group or groups, is preferably 0.6 or more, and more preferably 0.7 or more, and preferably 1.15 or less, and more preferably 1.10 or less, from the viewpoint of lowering an acid value of the polyester resin P.

The polycondensation of the alcohol component and the carboxylic acid component can be carried out, for example, in an inert gas atmosphere at a temperature of preferably 180° C. or higher and 250° C. or lower or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The amount of the esterification catalyst used is preferably 0.01 parts by mass or more and 1.5 parts by mass or less, and more preferably 0.1 parts by mass or more and 1.0 part by mass or less, based on 100 parts by mass of a total amount of the alcohol component and the carboxylic acid component. The esterification promoter includes gallic acid, and the like. The amount of the esterification promoter used is preferably 0.001 parts by mass or more and 0.5 parts by mass or less, and more preferably 0.01 parts by mass or more and 0.1 parts by mass or less, based on 100 parts by mass of a total amount of the alcohol component and the carboxylic acid component. The polymerization inhibitor includes tert-butyl catechol, and the like. The amount of the polymerization inhibitor used is preferably 0.001 parts by mass or more and 0.5 parts by mass or less, and more preferably 0.01 parts by mass or more and 0.1 part by mass or less, based on 100 parts by mass of a total amount of the alcohol component and the carboxylic acid component.

In the present invention, the polyester resin refers to a resin containing a polyester unit formed by polycondensation of the alcohol component and the carboxylic acid component. The polyester resin includes a polyester, a polyester-polyamide, a composite resin having two or more kinds of resin components including a polyester component, for example, a hybrid resin in which a polyester component and an addition polymerization-based resin component are partially chemically bonded via a dually reactive monomer, and the like. The content of the polyester unit is preferably 60% by mass or more, more preferably 80% by mass or more, even more preferably 90% by mass or more, and even more preferably 95% by mass or more, and preferably 100% by mass or less, and more preferably 100% by mass, of the polyester resin.

In addition, the polyester resin may be modified to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

It is preferable that a polyester resin P is amorphous rather than crystalline because the polyester resin enhances adsorption to a dispersant in the present invention and surface-modifying effects caused thereby. By the use of an amorphous polyester, formation of smaller particle sizes and lowered viscosity of the liquid developer are accelerated, thereby improving storage stability of the toner particles in the liquid developer, and further having excellent low-temperature fusing ability.

The softening point of the polyester resin P is preferably 75° C. or higher, more preferably 80° C. or higher, and even more preferably 85° C. or higher, from the viewpoint of improving high-temperature offset resistance, rubbing resistance, durability, and heat-resistant storage property of the toner, and the softening point is preferably 120° C. or lower, more preferably 110° C. or lower, even more preferably 95° C. or lower, and even more preferably 90° C. or lower, from the viewpoint of improving low-temperature fusing ability and pulverizability of the toner.

The softening point of the polyester resin can be controlled by adjusting the kinds and compositional ratios of the alcohol component and the carboxylic acid component, an amount of a catalyst, or the like, or selecting reaction conditions such as reaction temperature, reaction time and reaction pressure.

The glass transition temperature of the polyester resin P is 35° C. or higher, and preferably 40° C. or higher, from the viewpoint of improving rubbing resistance, durability, and heat-resistant storage property, and the glass transition temperature is preferably 65° C. or lower, more preferably 60° C. or lower, and even more preferably 50° C. or lower, from the viewpoint of improving low-temperature fusing ability and pulverizability of the toner.

The glass transition temperature of the polyester resin can be controlled by the kinds, compositional ratios, or the like of the alcohol component and the carboxylic acid component.

The acid value of the polyester resin P is preferably 1 mgKOH/g or more, more preferably 2 mgKOH/g or more, and even more preferably 3 mgKOH/g or more, from the viewpoint of improving pulverizability and low-temperature fusing ability of the toner particles, and the acid value is preferably 80 mgKOH/g or less, more preferably 60 mgKOH/g or less, even more preferably 50 mgKOH/g or less, even more preferably 40 mgKOH/g or less, even more preferably 30 mgKOH/g or less, even more preferably 20 mgKOH/g or less, and even more preferably 10 mgKOH/g or less, from the viewpoint of lowering a viscosity of toner particles in the liquid developer.

The acid value of the polyester resin can be controlled by adjusting the kinds and compositional ratios of the alcohol component and the carboxylic acid component, an amount of a catalyst, or the like, or selecting reaction conditions such as reaction temperature, reaction time and reaction pressure.

The liquid developer of the present invention may contain resins other than the polyester resin P within the range that would not impair the effects of the present invention. However, the content of the polyester resin P is preferably 90% by mass or more, and more preferably 95% by mass or more, and preferably 100% by mass or less, more preferably substantially 100% by mass, and even more preferably 100% by mass, of a total amount of the resins, i.e. it is even more preferable that only the polyester resin P is used as a resin binder. The resins other than the polyester resin P include, for example, polyester resins other than the polyester resin P, styrenic resins which are homopolymers or copolymers including styrene or a styrene substitute, such as polystyrenes, styrene-propylene copolymers, styrene-butadiene copolymers, styrene-vinyl chloride copolymers, styrene-vinyl acetate copolymers, styrene-maleic acid copolymers, styrene-acrylic ester copolymers, and styrene-methacrylic ester copolymers, epoxy resins, rosin-modified maleic acid resins, polyethylene-based resins, polypropylene, polyurethane, silicone resins, phenolic resins, aliphatic or alicyclic hydrocarbon resins, and the like.

As the pigment, all the pigments which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. In the present invention, the toner particles may be any one of black toners and color toners.

The content of the pigment is preferably 100 parts by mass or less, more preferably 70 parts by mass or less, even more preferably 50 parts by mass or less, and even more preferably 25 parts by mass or less, based on 100 parts by mass of the polyester resin P, from the viewpoint of improving pulverizability of the toner particles, thereby obtaining a liquid developer having smaller particle sizes, from the viewpoint of improving low-temperature fusing ability of the liquid developer, and from the viewpoint of improving storage stability of the toner particles in the liquid developer, and the content is preferably 5 parts by mass or more, more preferably 10 parts by mass or more, and even more preferably 15 parts by mass or more, based on 100 parts by mass of the polyester resin P, from the viewpoint of improving optical density of the liquid developer.

In the present invention, as toner raw materials, an additive such as a releasing agent, a charge control agent, a magnetic particulate, a fluidity improver, an electric conductivity modifier, a reinforcing filler such as a fibrous material, an antioxidant, or a cleanability improver, may be further properly used.

The liquid developer of the present invention contains toner particles containing a polyester resin P and a pigment, wherein the toner particles are dispersed in an insulating liquid in the presence of a dispersant.

In the present invention, the dispersant contains a copolymer C prepared by polymerizing a monomer A having an amino group and a monomer B represented by the above formula (I).

The monomer A having an amino group is preferably a monomer having an amino group represented by the formula (II):

$$CH_2{=}C(R^5)COYR^6NR^3R^4 \quad (II)$$

wherein each of $R^3$ and $R^4$ is independently a hydrogen atom, or a linear or branched alkyl group having 1 or more carbon atoms and 4 or less carbon atoms, which may be bonded to each other to form a ring structure; $R^5$ is a hydrogen atom or a methyl group; $R^6$ is a linear or branched alkylene group having 2 or more carbon atoms and 4 or less carbon atoms, and Y is —O— or —NH—, or an acid neutralized product (tertiary amine salt) or a quaternary ammonium salt of this monomer. Preferred acids for obtaining the above acid neutralized product include hydrochloric acid, sulfuric acid, nitric acid, acetic acid, formic acid, maleic acid, fumaric acid, citric acid, tartaric acid, adipic acid, sulfamic acid, toluenesulfonic acid, lactic acid, pyrrolidone-2-carboxylic acid, succinic acid, and the like. The preferred quaternary forming agent for obtaining the above quaternary ammonium salt includes alkyl halides such as methyl chloride, ethyl chloride, methyl bromide, and methyl iodide; and general alkylation agents such as dimethyl sulfate, diethyl sulfate, and di-n-propyl sulfate.

In the formula (II), each of $R^3$ and $R^4$ independently is preferably a linear or branched alkyl group having 1 or more carbon atoms and 4 or less carbon atoms, and $NR^3R^4$ is preferably a tertiary amino group. Specific examples of $R^3$ and $R^4$ include a methyl group, an ethyl group, a propyl group, an isopropyl group, and the like, and a methyl group is preferred.

$R^6$ includes an ethylene group, a propylene group, a butylene group, and the like, and an ethylene group is preferred.

In the formula (II), specific examples of the monomer in which $NR^3R^4$ is a tertiary amino group (tertiary amino group-containing monomer) include (meth)acrylic esters having a dialkylamino group, (meth)acrylamides having a dialkylamino group, and the like. Here, the term "(meth) acrylic ester" means to include both cases of acrylic ester and methacrylic ester, and the term "(meth)acrylamide" means to include both cases of acrylamide and methacrylamide.

The (meth)acrylic ester having a dialkylamino group includes one or more members selected from the group consisting of dimethylaminoethyl (meth)acrylate, diethylaminoethyl (meth)acrylate, dipropylaminoethyl (meth)acrylate, diisopropylaminoethyl (meth)acrylate, dibutylaminoethyl (meth)acrylate, diisobutylaminoethyl (meth)acrylate, and di-t-butylaminoethyl (meth)acrylate, and the like.

The (meth)acrylamide having a dialkylamino group includes one or more members selected from the group consisting of dimethylaminopropyl (meth)acrylamide, diethylaminopropyl (meth)acrylamide, dipropylaminopropyl (meth)acrylamide, diisopropylaminopropyl (meth)acrylamide, dibutylaminopropyl (meth)acrylamide, diisobutylaminopropyl (meth)acrylamide, and di-t-butylaminopropyl (meth)acrylamide, and the like.

Among them, the (meth)acrylic ester having a dialkylamino group is preferred, from the viewpoint of smaller particle sizes, lowered viscosity, storage stability, and low-temperature fusing ability, and dimethylaminoethyl (meth) acrylate is more preferred.

The monomer B is represented by the above formula (I), and in the above formula (I), the number of carbon atoms of the alkyl group and the alkenyl group represented by $R^2$ is preferably 10 or more, and more preferably 12 or more, from the viewpoint of lowered viscosity, storage stability, and low-temperature fusing ability, and the number of carbon atoms is 22 or less, preferably 18 or less, more preferably 16 or less, and even more preferably 14 or less, from the viewpoint of low-temperature fusing ability. The alkyl group or alkenyl group of $R^2$ may be linear or branched, which may have a substituent such as a hydroxyl group.

Therefore, it is preferable that the monomer B at least contains a monomer B2 in which $R^2$ is an alkyl group or alkenyl group having 10 or more carbon atoms and 22 or less carbon atoms.

In the monomer B, a molar ratio of a monomer B1 in which $R^2$ is an alkyl group having 1 or more carbon atoms and 9 or less carbon atoms or an alkenyl group having 2 or more carbon atoms and 9 or less carbon atoms to a monomer B2 in which $R^2$ is an alkyl group or alkenyl group having 10 or more carbon atoms and 22 or less carbon atoms, i.e. monomer B 1/monomer B2, is 0.1 or less, preferably 0.07 or less, more preferably 0.05 or less, even more preferably 0.03 or less, and even more preferably 0.01 or less, and 0 or more, and preferably 0, from the viewpoint of lowered viscosity, storage stability, and low-temperature fusing ability.

Specific examples of the monomer B include methyl (meth)acrylate, ethyl (meth)acrylate, (iso)propyl (meth) acrylate, 2-hydroxyethyl (meth)acrylate, (iso or tertiary) butyl (meth)acrylate, 2-ethylhexyl (meth)acrylate, (iso)octyl (meth)acrylate, (iso)nonyl (meth)acrylate, (iso)decyl (meth) acrylate, (iso)undecyl (meth)acrylate, (iso)dodecyl (meth) acrylate, (iso)tridecyl (meth)acrylate, (iso)tetradecyl (meth) acrylate, (iso)pentadecyl (meth)acrylate, (iso)hexadecyl (meth)acrylate, (iso)heptadecyl (meth)acrylate, (iso)octadecyl (meth)acrylate, (iso)nonadecyl (meth)acrylate, (iso)icosyl (meth)acrylate, (iso)eicosyl (meth)acrylate, (iso)henicosyl (meth)acrylate, (iso)docosyl (meth)acrylate, and the like. These monomer B can be used alone or in two or more kinds. Here, the expression "(iso or tertiary)" or "(iso)" means to embrace both cases where these groups are present and cases where they are absent, and in the cases where these groups are absent, they are normal form. Also, the expression "(meth)acrylate" means to embrace both acrylate and methacrylate.

The molar ratio of the monomer A to the monomer B (monomer A/monomer B) is 2/98 or more, preferably 3/97 or more, more preferably 5/95 or more, and even more preferably 7/93 or more, from the viewpoint of the function as a dispersant, lowered viscosity and storage stability, and the molar ratio is 50/50 or less, preferably 40/60 or less, more preferably 35/65 or less, even more preferably 25/75 or less, even more preferably 20/80 or less, and even more preferably 15/85 or less, from the viewpoint of lowered viscosity, storage stability, and low-temperature fusing ability.

A total content of the monomer A and the monomer B is preferably 80% by mass or more, more preferably 90% by mass or more, and even more preferably 95% by mass or more, and preferably 100% by mass or less, and more preferably 100% by mass, of the entire monomers usable in the copolymer C.

The polymerization of a monomer A and a monomer B can be carried out, for example, by heating the monomers in a solvent to a temperature of 40° to 140° C. or so in the presence of 2,2'-azobis(2,4-dimethylvaleronitrile) or the like to react.

The weight-average molecular weight of the copolymer C is preferably 5,000 or more, more preferably 10,000 or more, and even more preferably 15,000 or more, from the viewpoint of lowered viscosity and low-temperature fusing ability, and the weight-average molecular weight is preferably 100,000 or less, more preferably 50,000 or less, and even more preferably 30,000 or less, from the same viewpoint.

In addition, the number-average molecular weight of the copolymer C is preferably 2,000 or more, more preferably 2,500 or more, even more preferably 3,000 or more, and even more preferably 3,500 or more, from the viewpoint of lowered viscosity and low-temperature fusing ability, and the number-average molecular weight is preferably 10,000 or less, more preferably 9,000 or less, and even more preferably 8,000 or less, from the same viewpoint.

The content of the copolymer C, based on 100 parts by mass of the polyester resin P, is preferably 1 part by mass or more, more preferably 5 parts by mass or more, and even more preferably 7 parts by mass or more, from the viewpoint of improving low-temperature fusing ability, and the content is preferably 25 parts by mass or less, more preferably 20 parts by mass or less, and even more preferably 15 parts by mass or less, from the viewpoint of improving developing ability (electrophoretic property) of the liquid developer.

The liquid developer of the present invention may contain a known dispersant other than the copolymer C, but the content of the copolymer C is preferably 50% by mass or more, more preferably 70% by mass or more, even more preferably 90% by mass or more, and even more preferably 95% by mass or more, and preferably 100% by mass or less, more preferably substantially 100% by mass, and even more preferably 100% by mass, of the dispersant.

The insulating liquid in the present invention means a liquid through which electricity is less likely to flow, and in the present invention, the conductivity of the insulating liquid is preferably $1.0\times10^{-11}$ S/m or less, and more preferably $5.0\times10^{-12}$ S/m or less, and preferably $1.0\times10^{-13}$ S/m or more. In addition, it is preferable that the insulating liquid has a dielectric constant of 3.5 or less.

Specific examples of the insulating liquid include, for example, hydrocarbon solvents made of aliphatic hydrocarbons, alicyclic hydrocarbons, aromatic hydrocarbons, and halogenated hydrocarbons, polysiloxanes, vegetable oils, and the like, and one or more members selected from the group consisting of the hydrocarbon solvents and polysiloxanes are preferred. Among them, the hydrocarbon solvents are more preferred, from the viewpoint of low-temperature fusing ability, and aliphatic hydrocarbons are even more preferred, from the viewpoint of lowered viscosity and excellent balance between pulverizability, low-temperature fusing ability, and rubbing resistance. The aliphatic hydrocarbons include paraffin-based hydrocarbons, olefins having 12 or more carbon atoms and 18 or less carbon atoms, and the like. These insulating liquids can be used alone or in a combination of two or more kinds. Among the aliphatic hydrocarbons, the paraffin-based hydrocarbons are preferred, from the viewpoint of improving storage stability of the toner particles in the liquid developer, thereby improving low-temperature fusing ability of the liquid developer, and from the viewpoint of increasing electric resistance. The paraffin-based hydrocarbons include liquid paraffin, isoparaffin, and the like.

Commercially available products of the aliphatic hydrocarbons include Isopar G, Isopar H, Isopar L, Isopar K, Isopar M, Exxsol D110, hereinabove manufactured by Exxon Mobile Corporation; ShellSol 71, ShellSol™, hereinabove manufactured by Shell Chemicals Japan Ltd.; IP Solvent 1620, IP Solvent 2028, IP Solvent 2835, hereinabove manufactured by Idemitsu Kosan Co., Ltd.; MORESCO WHITE P-55, MORESCO WHITE P-70, MORESCO WHITE P-100, MORESCO WHITE P-150, MORESCO WHITE P-260, hereinabove manufactured by MORESCO Corporation; Cosmo White P-60, Cosmo White P-70, hereinabove manufactured by COSMO OIL LUBRICANTS, CO., LTD.: Lytol manufactured by Sonnebom; Isosol 400 manufactured by JX Nippon Oil & Energy Corporation, LINEALENE 14, LINEALENE 16, LINEALENE 18, LINEALENE 124, LINEALENE148, LINEALENE 168, hereinabove manufactured by Idemitsu Kosan Co., Ltd.; and the like.

The content of the hydrocarbon solvent is preferably 60% by mass or more, more preferably 80% by mass or more, even more preferably 90% by mass or more, and even more preferably 95% by mass or more, and preferably 100% by mass or less, more preferably substantially 100% by mass, and even more preferably 100% by mass, of the insulating liquid.

The viscosity of the insulating liquid at 25° C. is preferably 100 mPa·s or less, more preferably 50 mPa·s or less, even more preferably 20 mPa·s or less, even more preferably 10 mPa·s or less, and even more preferably 5 mPa·s or less, from the viewpoint of improving developing ability of the liquid developer, and the viscosity is preferably 1 mPa·s or more, and more preferably 1.5 mPa·s or more, from the viewpoint of improving storage stability of the toner particles in the liquid developer. Here, the viscosity of the insulating liquid is measured in accordance with the method described in Examples set forth below.

In the present invention, the method for obtaining toner particles includes a method including melt-kneading toner raw materials containing a polyester resin P and a pigment, and pulverizing a melt-kneaded product obtained; a method including mixing an aqueous resin dispersion and an aqueous pigment dispersion, thereby unifying the resin particles and the pigment particles; a method including stirring an aqueous resin dispersion and a pigment at high speed; and the like. The method including melt-kneading toner raw materials, and pulverizing the melt-kneaded product obtained is preferred, from the viewpoint of improving developing ability and fusing ability of the liquid developer. From the above viewpoint, it is preferable that the liquid developer of the present invention is produced by a method including:

step 1: melt-kneading at least a resin binder containing a polyester resin P and a pigment, and pulverizing a kneaded product obtained to provide toner particles; and step 2: dispersing the toner particles obtained in the step 1 in an insulating liquid in the presence of a dispersant.

In the step 1, at least a resin binder containing a polyester resin P and a pigment are melt-kneaded, and a kneaded product obtained is pulverized to provide toner particles.

The melt-kneading of the step 1 can be carried out with a known kneader, such as a tightly closed kneader, a single-screw or twin-screw extruder, or an open-roller type kneader. It is preferable that the melt-kneading is carried out with an open-roller type kneader, from the viewpoint of being capable of efficiently and highly dispersing the pigment in the resin, without having to repeat kneading or use a dispersion aid.

It is preferable that a resin binder containing a polyester resin P and a pigment are previously mixed with a mixer such as a Henschel mixer or a ball-mill, and thereafter fed to a kneader. In addition, an additive such as a releasing agent or a charge control agent may optionally be fed to be melt-kneaded together with the resin or the like.

The open-roller type kneader refers to a kneader of which kneading unit is an open type, not being tightly closed, and the kneading heat generated during the kneading can be easily dissipated. In addition, it is preferable that a continuous open-roller type kneader is a kneader provided with at least two rollers. The continuous open-roller type kneader usable in the present invention is a kneader provided with two rollers having different peripheral speeds, in other words, two rollers of a high-rotation roller having a high peripheral speed and a low-rotation roller having a low peripheral speed. In the present invention, it is preferable that the high-rotation roller is a heat roller, and that the low-rotation roller is a cooling roller, from the viewpoint of improving dispersibility of the pigment in the resin.

The temperature of the roller can be adjusted by, for example, a temperature of a heating medium passing through the inner portion of the roller, and each roller may be divided in two or more portions in the inner portion of the roller, each being passed through with heating media of different temperatures.

The temperature at the end part of the raw material-supplying side of the high-rotation roller is preferably 80° C. or higher and 160° C. or lower, from the viewpoint of reducing mechanical forces during melt-kneading, thereby controlling the generation of heat, and from the viewpoint of improving dispersibility of the pigment in the polyester resin P, and the temperature at the end part of the raw material-supplying side of the low-rotation roller is preferably 30° C. or higher and 100° C. or lower, from the same viewpoint.

In the high-rotation roller, the difference between setting temperatures of the end part of the raw material-supplying side and the end part of the kneaded product-discharging side is preferably 2° C. or more, and preferably 60° C. or less, more preferably 50° C. or less, and even more preferably 30° C. or less, from the viewpoint of preventing detachment of the kneaded product from the roller, from the viewpoint of reducing mechanical forces during melt-kneading, thereby controlling the generation of heat, and from the viewpoint of improving dispersibility of the pigment in the polyester resin. In the low-rotation roller, the difference between setting temperatures of the end part of the raw material-supplying side and the end part of the kneaded product-discharging side is preferably 50° C. or less, and more preferably 30° C. or less, and may be 0° C., from the viewpoint of reducing mechanical forces during melt-kneading, thereby controlling the generation of heat, and from the viewpoint of improving dispersibility of the pigment in the resin.

The peripheral speed of the high-rotation roller is preferably 2 m/min or more, more preferably 10 m/min or more, and even more preferably 25 m/min or more, and preferably 100 m/min or less, more preferably 75 m/min or less, and even more preferably 50 m/min or less, from the viewpoint of reducing mechanical forces during melt-kneading, thereby controlling the generation of heat, and from the viewpoint of improving dispersibility of the pigment in the polyester resin P. The peripheral speed of the low-rotation roller is preferably 1 m/min or more, more preferably 5 m/min or more, and even more preferably 10 m/min or more, and preferably 90 m/min or less, more preferably 60 in/min or less, even more preferably 30 m/min or less, and even more preferably 20 m/min or less, from the same viewpoint. In addition, the ratio between the peripheral speeds of the two rollers, i.e., low-rotation roller/high-rotation roller, is preferably 1/10 or more, and more preferably 3/10 or more, and preferably 9/10 or less, and more preferably 8/10 or less.

Structures, size, materials and the like of the roller are not particularly limited. Also, the surface of the roller may be any of smooth, wavy, rugged, or other surfaces. It is preferable that plural spiral ditches are engraved on the surface of each roller, from the viewpoint of reducing mechanical forces during melt-kneading, thereby controlling the generation of heat, and from the viewpoint of improving dispersibility of the pigment in the resin.

The kneaded product obtained by melt-kneading the components is appropriately cooled to an extent of pulverizable hardness, and pulverized.

The pulverization may be carried out in divided multi-stages. For example, the resin kneaded product may be roughly pulverized to a size of from 1 to 5 mm or so, and the roughly pulverized product may then be further finely pulverized to a desired particle size.

The pulverizer usable in the pulverizing step is not particularly limited. For example, the pulverizer suitably used in the rough pulverization includes a hammer-mill, an atomizer, Rotoplex, and the like. The pulverizer suitably used in the fine pulverization includes an air jet mill, a fluidised bed opposed jet mill, an impact type jet mill, a rotary mechanical mill, and the like.

In the step 1, it is preferable that the toner particles obtained after pulverization are classified as occasion demands.

The classifier usable in the classification step includes an air classifier, a rotor type classifier, a sieve classifier, and the like. The pulverized product which is insufficiently pulverized and removed during the classifying step may be subjected to the pulverizing step again, and the pulverizing step and the classifying step may be repeated as occasion demands.

The volume-median particle size $D_{50}$ of the toner particles obtained by the step 1 is preferably 3 μm or more, and more preferably 4 μm or more, and preferably 15 μm or less, and more preferably 12 μm or less, from the viewpoint of improving productivity of the wet-milling step described later. Here, the volume-median particle size $D_{50}$ as used herein means a particle size of which cumulative volume frequency calculated on a volume percentage is 50% counted from the smaller particle sizes.

The step 2 is a step of dispersing the toner particles obtained in the step 1 in an insulating liquid, in the presence of a dispersant.

In the present invention, from the viewpoint of making particle sizes of the toner particles in the liquid developer smaller, and from the viewpoint of lowering viscosity of the liquid developer, it is preferable that the step 2 is carried out by a method including the step 2-1 and the step 2-2 given below.

step 2-1: adding a dispersant to the toner particles obtained in the step 1 to disperse in an insulating liquid to provide a dispersion of the toner particles; and step 2-2: subjecting the dispersion of the toner particles obtained in the step 2-1 to wet-milling, to provide a liquid developer.

In the step 2-1, it is preferable that a method for mixing toner particles, an insulating liquid, and a dispersant is a method including stirring the components with an agitation mixer, or the like.

The agitation mixer is, but not particularly limited to, preferably high-speed agitation mixers, from the viewpoint of improving productivity and storage stability of the dispersion of toner particles. Specific examples are preferably DESPA manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX manufactured by M Technique Co., Ltd.; KADY Mill manufactured by KADY International, and the like.

The toner particles are previously dispersed by mixing toner particles, an insulating liquid, and a dispersant with a high-speed agitation mixer, whereby a dispersion of toner particles can be obtained, which in turn improves productivity of a liquid developer obtained by the subsequent wet-milling.

The subsequent step 2-2 is a step of subjecting a dispersion of the toner particles obtained in the step 2-1 to wet-milling to provide a liquid developer. The wet-milling refers to a method of subjecting toner particles dispersed in an insulating liquid to a mechanical milling treatment in the state of dispersion in the insulating liquid.

The solid content concentration of the dispersion of toner particles subjected to wet milling is preferably 20% by mass or more, more preferably 30% by mass or more, and even more preferably 33% by mass or more, from the viewpoint of improving optical density of the liquid developer, and the solid content concentration is preferably 50% by mass or less, more preferably 45% by mass or less, and even more preferably 40% by mass or less, from the viewpoint of improving storage stability of the toner particles in a liquid developer. Here, the solid content concentration of the dispersion of toner particles is measured in accordance with a method described in Examples set forth below.

As the apparatus used in the wet-milling, for example, generally used agitation mixers such as anchor blades can be used. The agitation mixers include high-speed agitation mixers such as DESPA manufactured by ASADA IRON WORKS CO., LTD., and T.K. HOMOGENIZING MIXER manufactured by PRIMIX Corporation; pulverizers and kneaders, such as roller mills, beads-mills, kneaders, and extruders; and the like. These apparatuses can also be used in a combination of plural apparatuses.

Among them, the beads-mills are preferably used, from the viewpoint of making particle sizes of the toner particles in a liquid developer smaller, from the viewpoint of improving storage stability of the toner particles in a liquid developer, and from the viewpoint of lowering viscosity of the dispersion of toner particles.

By controlling particle sizes and filling ratios of media used, peripheral speed of rotors, residence time, and the like in the beads mill, toner particles having a desired particle size and a particle size distribution can be obtained.

The solid content concentration of the liquid developer is preferably 10% by mass or more, more preferably 15% by mass or more, and even more preferably 20% by mass or more, from the viewpoint of improving optical density of the liquid developer, and the solid content concentration is preferably 50% by mass or less, more preferably 45% by mass or less, even more preferably 40% by mass or less, and even more preferably 30% by mass or less, from the viewpoint of improving storage stability of the toner particles in the liquid developer. Here, the solid content concentration of the liquid developer is measured in accordance with a method described in Examples set forth below. After the preparation of the dispersion of toner particles, the solid content concentration of the dispersion of toner particles would be a solid content concentration of the liquid developer unless the dispersion is subjected to such a procedure as dilution or concentration. The dispersion may be diluted with an insulating liquid after wet-milling to adjust the solid content concentration.

The content of the polyester resin P in the liquid developer of the present invention, is preferably 3% by mass or more, more preferably 5% by mass or more, even more preferably 10% by mass or more, and even more preferably 15% by mass or more, from the viewpoint of improvement in storage stability of the toner particles in the liquid developer, and lowered viscosity, and the content is preferably 40% by mass or less, more preferably 30% by mass or less, and even more preferably 25% by mass or less, from the viewpoint of improving pulverizability of the liquid developer. Here, upon the production of a liquid developer, the content of the polyester resin P in the liquid developer as used herein is defined as a content in the liquid developer after the dilution, in a case where the toner particles are dispersed in an insulating liquid and diluted to provide a liquid developer. The same applies hereinafter for the pigment, the dispersant, and the copolymer C.

The content of the pigment in the liquid developer of the present invention is preferably 1% by mass or more, more preferably 1.5% by mass or more, and even more preferably 2% by mass or more, from the viewpoint of improving optical density of the liquid developer, and the content is preferably 10% by mass or less, more preferably 8% by mass or less, even more preferably 7% by mass or less, and even more preferably 5% by mass or less, from the viewpoint of improvement in storage stability of the toner particles in the liquid developer, and lowered viscosity.

The content of the dispersant in the liquid developer of the present invention is preferably 0.05% by mass or more, more preferably 0.1% by mass or more, even more preferably 0.5% by mass or more, and even more preferably 1% by mass or more, from the viewpoint of improvement in storage stability of the toner particles in the liquid developer, and lowered viscosity, and the content is preferably 8% by mass or less, more preferably 6% by mass or less, and even more preferably 4% by mass or less, from the viewpoint of improving low-temperature fusing ability of the liquid developer.

In addition, the content of the copolymer C in the liquid developer of the present invention is preferably 0.05% by mass or more, more preferably 0.1% by mass or more, even more preferably 0.2% by mass or more, and even more preferably 0.3% by mass or more, from the viewpoint of improvement in storage stability of the toner particles in the liquid developer, and lowered viscosity, and the content is preferably 8% by mass or less, more preferably 6% by mass or less, and even more preferably 4% by mass or less, from the viewpoint of improving low-temperature fusing ability of the liquid developer.

The volume-median particle size $D_{50}$ of the toner particles in the liquid developer is preferably 5 μm or less, more preferably 3 μm or less, and even more preferably 2.5 μm or less, from the viewpoint of making particle sizes of the toner particles in the liquid developer smaller and improving image quality of the liquid developer, and the volume-median particle size is preferably 0.5 μm or more, more preferably 1.0 μm or more, and even more preferably 1.5 μm or more, from the viewpoint of lowering the viscosity of the liquid developer. Here, the volume-median particle size $D_{50}$ of the toner particles in the liquid developer is measured in accordance with a method described in Examples set forth below.

The viscosity of the liquid developer at 25° C. is preferably 30 mPa·s or less, more preferably 20 mPa·s or less, even more preferably 15 mPa·s or less, and even more preferably 10 mPa·s or less, from the viewpoint of improving fusing ability of the liquid developer, and the viscosity is preferably 1 mPa·s or more, more preferably 2 mPa·s or more, even more preferably 3 mPa·s or more, and even more preferably 4 mPa·s or more, from the viewpoint of improving storage stability of the toner particles in the liquid developer. Here, the viscosity of the liquid developer is measured in accordance with a method described in Examples set forth below.

With regard to the embodiments described above, the present invention further discloses the following liquid developer and the method for producing the same.

<1> A liquid developer containing toner particles containing a resin binder and a pigment, wherein the toner particles are dispersed in an insulating liquid in the presence of a dispersant, wherein the above resin binder contains a polyester resin P having a glass transition temperature of 35° C. or higher, obtained by polycondensing raw material monomers containing an alcohol component containing an aliphatic diol having 2 or more carbon atoms and 6 or less carbon atoms in an amount of 70% by mol or more and 100% by mol or less, and a carboxylic acid component, and wherein the above dispersant contains a copolymer C prepared by polymerizing a monomer A having an amino group and a monomer B represented by the formula (I), wherein a molar ratio of the monomer A to the monomer B (monomer A/monomer B) is 2/98 or more and 50/50 or less, and a molar ratio of a monomer B1 in which $R^2$ in the monomer B is an alkyl group having 1 or more carbon atoms and 9 or less carbon atoms or an alkenyl group having 2 or more carbon atoms and 9 or less carbon atoms to a monomer B2 in which $R^2$ in the monomer B is an alkyl group or alkenyl group having 10 or more carbon atoms and 22 or less carbon atoms (monomer B 1/monomer B2) is 0 or more and 0.1 or less.

<2> The liquid developer according to the above <1>, wherein the number of carbon atoms of the aliphatic diol is 3 or more and 4 or less.

<3> The liquid developer according to the above <1> or <2>, wherein the aliphatic diol is an aliphatic diol having a hydroxyl group bonded to a secondary carbon atom.

<4> The liquid developer according to any one of the above <1> to <3>, wherein the content of the aliphatic diol having 2 or more carbon atoms and 6 or less carbon atoms is 80% by mol or more, preferably 90% by mol or more, more preferably 95% by mol or more, even more preferably 99% by mol or more, and even more preferably 100% by mol, of the alcohol component.

<5> The liquid developer according to the above <3> or <4>, wherein the content of the aliphatic diol having a hydroxyl group bonded to a secondary carbon atom is 80% by mol or more, preferably 90% by mol or more, and more preferably 95% by mol or more, and preferably 100% by mol or less, and preferably 100% by mol, of the alcohol component.

<6> The liquid developer according to any one of the above <1> to <5>, wherein the carboxylic acid component contains an aromatic dicarboxylic acid compound.

<7> The liquid developer according to the above <6>, wherein the content of the aromatic dicarboxylic acid compound is 50% by mol or more, preferably 80% by mol or more, more preferably 90% by mol or more, and even more preferably 95% by mol or more, and preferably 100% by mol or less, more preferably substantially 100% by mol, and even more preferably 100% by mol, of the carboxylic acid component.

<8> The liquid developer according to any one of the above <1> to <7>, wherein the polyester resin P is a resin containing a polyester unit, wherein the content of the polyester unit is 60% by mass or more, preferably 80% by mass or more, more preferably 90% by mass or more, and even more preferably 95% by mass or more, and preferably 100% by mass or less, and more preferably 100% by mass, of the polyester resin.

<9> The liquid developer according to any one of the above <1> to <8>, wherein the softening point of the polyester resin P is 75° C. or higher, preferably 80° C. or higher, and more preferably 85° C. or higher, and 120° C. or lower, preferably 110° C. or lower, more preferably 95° C. or lower, and even more preferably 90° C. or lower.

<10> The liquid developer according to any one of the above <1> to <9>, wherein the glass transition temperature of the polyester resin P is 35° C. or higher, and preferably 40° C. or higher, and 65° C. or lower, preferably 60° C. or lower, and more preferably 50° C. or lower.

<11> The liquid developer according to any one of the above <1> to <10>, wherein the acid value of the polyester resin P is 1 mgKOH/g or more, preferably 2 mgKOH/g or more, and more preferably 3 mgKOH/g or more, and 80 mgKOH/g or less, preferably 60 mgKOH/g or less, more preferably 50 mgKOH/g or less, even more preferably 40 mgKOH/g or less, even more preferably 30 mgKOH/g or less, even more preferably 20 mgKOH/g or less, and even more preferably 10 mgKOH/g or less.

<12> The liquid developer according to any one of the above <1> to <11>, wherein the content of the polyester resin P is 90% by mass or more, and preferably 95% by mass or more, and preferably 100% by mass or less, more preferably substantially 100% by mass, and even more preferably 100% by mass, of a total amount of the resins.

<13> The liquid developer according to any one of the above <1> to <12>, wherein the content of the pigment is 100 parts by mass or less, preferably 70 parts by mass or less, more preferably 50 parts by mass or less, and even more preferably 25 parts by mass or less, and 5 parts by mass or more, preferably 10 parts by mass or more, and more preferably 15 parts by mass or more, based on 100 parts by mass of the polyester resin P.

<14> The liquid developer according to any one of the above <1> to <13>, wherein the monomer A having an amino group is at least one member selected from the group consisting of a monomer having an amino group represented by the formula (II), an acid neutralized product (tertiary amine salt) and a quaternary ammonium salt of this monomer.

<15> The liquid developer according to the above <14>, wherein in the formula (II), each of $R^3$ and $R^4$ independently is a linear or branched alkyl group having 1 or more carbon atoms and 4 or less carbon atoms, and $NR^3R^4$ is a tertiary amino group.

<16> The liquid developer according to the above <14> or <15>, wherein the monomer in which $NR^3R^4$ is a tertiary amino group (tertiary amino group-containing monomer) in the formula (II) is at least one member selected from the group consisting of (meth)acrylic esters having a dialkylamino group, and (meth)acrylamides having a dialkylamino group.

<17> The liquid developer according to the above <16>, wherein the (meth)acrylic ester having a dialkylamino group is one or more members selected from the group consisting of dimethylaminoethyl (meth)acrylate, diethylaminoethyl (meth)acrylate, dipropylaminoethyl (meth)acrylate, diisopropylaminoethyl (meth)acrylate, dibutylaminoethyl (meth) acrylate, diisobutylaminoethyl (meth)acrylate, and di-t-butylaminoethyl (meth)acrylate, and preferably dimethylaminoethyl (meth)acrylate.

<18> The liquid developer according to the above <16> or <17>, wherein the (meth)acrylamide having a dialkylamino group is one or more members selected from the group consisting of dimethylaminopropyl (meth)acrylamide, diethylaminopropyl (meth)acrylamide, dipropylaminopropyl (meth)acrylamide, diisopropylaminopropyl (meth) acrylamide, dibutylaminopropyl (meth)acrylamide, diisobutylaminopropyl (meth)acrylamide, and di-t-butylaminopropyl (meth)acrylamide.

<19> The liquid developer according to any one of the above <1> to <18>, wherein in the formula (I), the number of carbon atoms of the alkyl group and the alkenyl group represented by $R^2$ is 10 or more, and preferably 12 or more, and 18 or less, preferably 16 or less, and more preferably 14 or less.

<20> The liquid developer according to any one of the above <1> to <19>, wherein in the monomer B, a molar ratio of a monomer B1 in which $R^2$ is an alkyl group having 1 or more carbon atoms and 9 or less carbon atoms or an alkenyl group having 2 or more carbon atoms and 9 or less carbon atoms to a monomer B2 in which $R^2$ is an alkyl group or alkenyl group having 10 or more carbon atoms and 22 or less carbon atoms, i.e. monomer B 1/monomer B2, is 0.07 or less, preferably 0.05 or less, more preferably 0.03 or less, and even more preferably 0.01 or less, and preferably 0.

<21> The liquid developer according to any one of the above <1> to <20>, wherein the molar ratio of the monomer A to the monomer B, i.e. monomer A/monomer B, is 3/97 or more, preferably 5/95 or more, and more preferably 7/93 or more, and 40/60 or less, preferably 35/65 or less, more preferably 25/75 or less, even more preferably 20/80 or less, and even more preferably 15/85 or less.

<22> The liquid developer according to any one of the above <1> to <21>, wherein the weight-average molecular weight of the copolymer C is 5,000 or more, preferably 10,000 or more, and more preferably 15,000 or more, and 100,000 or less, preferably 50,000 or less, and more preferably 30,000 or less.

<23> The liquid developer according to any one of the above <1> to <22>, wherein the number-average molecular weight of the copolymer C is 2,000 or more, preferably 2,500 or more, more preferably 3,000 or more, and even more preferably 3,500 or more, and 10,000 or less, preferably 9,000 or less, and more preferably 8,000 or less.

<24> The liquid developer according to any one of the above <1> to <23>, wherein the content of the copolymer C is 1 part by mass or more, preferably 5 parts by mass or more, and more preferably 7 parts by mass or more, and 25 parts by mass or less, preferably 20 parts by mass or less, and more preferably 15 parts by mass or less, based on 100 parts by mass of the polyester resin P.

<25> The liquid developer according to any one of the above <1> to <24>, wherein the insulating liquid contains a hydrocarbon solvent, preferably an aliphatic hydrocarbon, and more preferably a paraffin-based hydrocarbon.

<26> The liquid developer according to the above <25>, wherein the content of the hydrocarbon solvent is 60% by mass or more, preferably 80% by mass or more, more preferably 90% by mass or more, and even more preferably 95% by mass or more, and preferably 100% by mass or less, more preferably substantially 100% by mass, and even more preferably 100% by mass, of the insulating liquid.

<27> The liquid developer according to any one of the above <1> to <26>, wherein the viscosity of the insulating liquid at 25° C. is 100 mPa·s or less, preferably 50 mPa·s or less, more preferably 20 mPa·s or less, even more preferably 10 mPa·s or less, and even more preferably 5 mPa·s or less, and 1 mPa·s or more, and preferably 1.5 mPa·s or more.

<28> The liquid developer according to any one of the above <1> to <27>, wherein the solid content concentration of the liquid developer is 10% by mass or more, preferably 15% by mass or more, and more preferably 20% by mass or more, and 50% by mass or less, preferably 45% by mass or less, more preferably 40% by mass or less, and even more preferably 30% by mass or less.

<29> The liquid developer according to any one of the above <1> to <28>, wherein the content of the polyester resin P is 3% by mass or more, preferably 5% by mass or more, more preferably 10% by mass or more, and even more preferably 15% by mass or more, and 40% by mass or less, preferably 30% by mass or less, and more preferably 25% by mass or less, of the liquid developer.

<30> The liquid developer according to any one of the above <1> to <29>, wherein the content of the pigment is 1% by mass or more, preferably 1.5% by mass or more, and more preferably 2% by mass or more, and 10% by mass or less, preferably 8% by mass or less, more preferably 7% by mass or less, and even more preferably 5% by mass or less, of the liquid developer.

<31> The liquid developer according to any one of the above <1> to <30>, wherein the content of the dispersant is 0.05% by mass or more, preferably 0.1% by mass or more, more preferably 0.5% by mass or more, and even more preferably 1% by mass or more, and 8% by mass or less, preferably 6% by mass or less, and more preferably 4% by mass or less, of the liquid developer.

<32> The liquid developer according to any one of the above <1> to <31>, wherein the content of the copolymer C is 0.05% by mass or more, preferably 0.1% by mass or more, more preferably 0.2% by mass or more, and even more preferably 0.3% by mass or more, and 8% by mass or less, preferably 6% by mass or less, and more preferably 4% by mass or less, of the liquid developer.

<33> The liquid developer according to any one of the above <1> to <32>, wherein the volume-median particle size $D_{50}$ of the toner particles in the liquid developer is 5 μm or less, preferably 3 μm or less, and more preferably 2.5 μm or less, and 0.5 μm or more, preferably 1.0 μm or more, and more preferably 1.5 μm or more.

<34> The liquid developer according to any one of the above <1> to <33>, wherein the viscosity of the liquid developer at 25° C. is 30 mPa·s or less, preferably 20 mPa·s or less, more preferably 15 mPa·s or less, and even more preferably 10 mPa·s or less, and 1 mPa·s or more, preferably 2 mPa·s or more, more preferably 3 mPa·s or more, and even more preferably 4 mPa·s or more.

<35> A method for producing a liquid developer, including:

step 1: melt-kneading at least a resin binder and a pigment, and pulverizing a kneaded product obtained, to provide toner particles; and step 2: dispersing toner particles obtained in the step 1 in an insulating liquid in the presence of a dispersant, wherein the above resin binder contains a polyester resin P having a glass transition temperature of 35° C. or higher, obtained by polycondensing raw material monomers containing an alcohol component containing an aliphatic diol having 2 or more carbon atoms and 6 or less carbon atoms in an amount of 70% by mol or more and 100% by mol or less, and a carboxylic acid component, and wherein the above dispersant contains a copolymer C prepared by polymerizing a monomer A having an amino group and a monomer B represented by the formula (I), wherein a molar ratio of the monomer A to the monomer B (monomer A/monomer B) is 2/98 or more and 50/50 or less, and a molar ratio of a monomer B1 in which $R^2$ in the monomer B is an alkyl group having 1 or more carbon atoms and 9 or less carbon atoms or an alkenyl group having 2 or more carbon atoms and 9 or less carbon alkenyl group having 10 or more carbon atoms and 22 or less carbon atoms (monomer B1/monomer B2) is 0 or more and 0.10 or less.

<36> The method for producing a liquid developer according to the above <35>, wherein the volume-median particle size $D_{50}$ of the toner particles obtainable in the step 1 is 3 μm or more, and preferably 4 μm or more, and 15 μm or less, and preferably 12 μm or less.

<37> The method for producing a liquid developer according to the above <35> or <36>, wherein the step 2 includes:

step 2-1: adding a dispersant to the toner particles obtained in the step 1 to disperse in an insulating liquid to provide a dispersion of the toner particles; and step 2-2: subjecting the dispersion of the toner particles obtained in the step 2-1 to wet-milling, to provide a liquid developer.

The present invention will be described hereinbelow more specifically by the Examples, without intending to limit the present invention to these Examples. The physical properties of the resins and the like were measured in accordance with the following methods.

[Softening Point of Resin]

Using a flow tester "CFT-500D," manufactured by Shimadzu Corporation, a 1 g sample is extruded through a nozzle having a diameter of 1 mm and a length of 1 mm with applying a load of 1.96 MPa thereto with a plunger, while heating the sample at a heating rate of 6° C./min. The softening point refers to a temperature at which half of the sample flows out, when plotting a downward movement of the plunger of the flow tester against temperature.

[Glass Transition Temperature of Resin]

Using a differential scanning calorimeter "Q20," manufactured by TA Instruments, a 0.01 to 0.02 g sample is weighed out in an aluminum pan, heated to 200° C., and cooled from that temperature to 0° C. at a cooling rate of 10° C./min. Next, the temperature of the sample is raised at a heating rate of 10° C./min to measure endothermic peaks. A temperature of an intersection of the extension of the baseline of equal to or lower than the highest temperature of endothermic peak and the tangential line showing the maximum inclination between the kick-off of the peak and the top of the peak is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Number-Average Molecular Weight (Mn) and Weight-Average Molecular Weight (Mw) of Dispersant]

The number-average molecular weight and the weight-average molecular weight (Mw) are obtained by measuring a molecular weight distribution in accordance with a gel permeation chromatography (GPC) method as shown by the following method.

(1) Preparation of Sample Solution

A dispersant (prepared by distilling off an insulating liquid from the dispersant solution) was dissolved in tetrahydrofuran so as to have a concentration of 0.5 g/100 mL. Next, this solution was filtered with a fluororesin filter "FP-200," manufactured by Sumitomo Electric Industries, Ltd., having a pore size of 2 μm, to remove insoluble components, to provide a sample solution.

(2) Measurement of Molecular Weight Distribution

Using the following measurement apparatus and analyzing column, the measurement is taken by allowing tetrahydrofuran to flow through a column as an eluent at a flow rate of 1 mL per minute, and stabilizing the column in a thermostat at 40° C., and loading 100 μL of a sample solution thereto. The molecular weight of the sample is calculated based on the previously drawn calibration curve. At this time, a calibration curve drawn from several kinds of monodisperse polystyrenes, manufactured by Tosoh Corporation, A-500 ($5.0\times10^2$), A-1000 ($1.01\times10^3$), A-2500 ($2.63\times10^3$), A-5000 ($5.97\times10^3$), F-1 ($1.02\times10^4$), F-2 ($1.81\times10^4$), F-4 ($3.97\times10^4$), F-10 ($9.64\times10^4$), F-20 ($1.90\times10^5$), F-40 ($4.27\times10^5$), F-80 ($7.06\times10^5$), and F-128 ($1.09\times10^6$) as standard samples is used. The values within the parentheses show molecular weights.

Measurement Apparatus: HLC-8220GPC, manufactured by Tosoh Corporation

Analyzing Column; TSKgel $GMH_{xL}$+TSKgel $G3000H_{xL}$, manufactured by Tosoh Corporation.

[Volume-Median Particle Size of Toner Particles Before Mixing with Insulating Liquid]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Dispersion: EMULGEN 109P, manufactured by Kao Corporation, polyoxyethylene lauryl ether, HLB (Griffin): 13.6, is dissolved in the electrolytic solution to adjust to a concentration of 5% by mass to provide a dispersion.

Dispersion Conditions: Ten milligrams of a measurement sample is added to 5 mL of the above dispersion, and the mixture is dispersed for 1 minute with an ultrasonic disperser (name of machine: US-1, manufactured by SND Co., Ltd., output: 80 W), and 25 mL of the above electrolytic solution is then added to the dispersion, and further dispersed with the ultrasonic disperser for 1 minute, to prepare a sample dispersion.

Measurement Conditions: The above sample dispersion is added to 100 mL of the above electrolytic solution so as to have a concentration at which particle sizes of 30,000 particles can be measured in 20 seconds, and the 30,000 particles are measured, and a volume-median particle size $D_{50}$ is obtained from the particle size distribution.

[Conductivity of Insulating Liquid]

A 40 mL glass sample vial "Vial with screw cap, No. 7," manufactured by Maruemu Corporation is charged with 25 g of an insulating liquid. The conductivity is determined by immersing an electrode in a liquid developer, taking 20 measurements for conductivity with a non-aqueous conductivity meter "DT-700," manufactured by Dispersion Technology, Inc., and calculating an average thereof. The smaller the numerical figures, the higher the resistance.

[Viscosities at 25° C. of Insulating Liquid and Liquid Developer]

A 6 mL glass sample vial "Vial with screw cap, No. 2," manufactured by Maruemu Corporation is charged with 4 to 5 mL of a measurement solution, and a viscosity at 25° C. is measured with a torsional oscillation type viscometer "VISCOMATE VM-10A-L," manufactured by SEKONIC CORPORATION.

[Solid Content Concentrations of Dispersion of Toner Particles and Liquid Developer]

Ten parts by mass of a sample is diluted with 90 parts by mass of hexane, and the dilution is rotated with a centrifuge "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and the lower layer is then dried with a vacuum dryer at 0.5 kPa and 40° C. for 8 hours. The solid content concentration is calculated according to the following formula:

$$\text{Solid Content Concentration, \% by Mass} = \frac{\text{Mass of Residues After Drying}}{\text{Mass of Sample, Corresponding to 10 Parts by Mass Portion}} \times 100$$

[Volume-Median Particle Size $D_{50}$ of Toner Particles in Liquid Developer]

A volume-median particle size $D_{50}$ is determined with a laser diffraction/scattering particle size measurement instrument "Mastersizer 2000," manufactured by Malvern Instruments, Ltd., by charging a cell for measurement with Isopar L, manufactured by Exxon Mobile Corporation, isoparaffin, viscosity at 25° C. of 1 mPa·s, under conditions that a particle refractive index is 1.58, imaginary part being 0.1, and a dispersion medium refractive index is 1.42, at a concentration that gives a scattering intensity of from 5 to 15%.

PRODUCTION EXAMPLE 1 OF RESINS—RESINS A AND C

A 10-L four-neck flask equipped with a nitrogen inlet tube, a dehydration tube, a stirrer, and a thermocouple was charged with raw material monomers as listed in Table 1 and 50 g of an esterification catalyst (dibutyltin oxide). The contents were heated with a mantle heater to 180° C., then heated to 220° C. over 10 hours, and reacted at 220° C. until a reaction percentage reached 90%, and the reaction mixture was further reacted at 8.3 kPa until softening point as listed in Table 1 was reached, to provide each of polyesters having physical properties as shown in Table 1. Here, the reaction percentage refers to a value calculated by:

[amount of generated water in reaction (mol)/theoretical amount of generated water (mol)]×100.

PRODUCTION EXAMPLE 2 OF RESIN—RESIN B

A 10-L four-neck flask equipped with a nitrogen inlet tube, a dehydration tube, a stirrer, and a thermocouple was charged with raw material monomers as listed in Table 1, 30 g of an esterification catalyst (dibutyltin oxide), and 3 g of an esterification promoter (gallic acid). The contents were heated to 230° C., and reacted until a reaction percentage reached 90%, and the reaction mixture was then further reacted at 8.3 kPa until a softening point as listed in Table 1 was reached, to provide a polyester having physical properties as shown in Table 1.

TABLE 1

| Resin Binder | | | Resin A | Resin B | Resin C |
|---|---|---|---|---|---|
| Raw Material Monomers | Alcohol Component | BPA-PO* | — | 7,402 g (100) | 5,211 g (50) |
| | | 1,2-Propanediol | 3,822 g (100) | — | 1,131 g (50) |
| | Carboxylic Acid Component | Terephthalic Acid | 6,178 g (74) | 2,598 g (74) | 3,658 g (74) |
| Physical Properties of Resin | | Softening Point, ° C. | 88 | 90 | 88 |
| | | Glass Transition Temperature, ° C. | 43 | 50 | 47 |
| | | Acid Value, mgKOH/g | 4 | 6 | 6 |

Note)

The numerical figures inside the parentheses are expressed by a molar ratio when a total number of moles of alcohol component is defined as 100 mol.

*BPA-PO: Polyoxypropylene(2.2)-2,2-bis(4-hydroxyphenyl)propane

PRODUCTION EXAMPLE OF DISPERSANTS—DISPERSANTS A TO I

A 2-L four-necked flask equipped with a reflux condenser, a nitrogen inlet tube, a stirrer, and a thermocouple was charged with 100 g of a solvent (methyl ethyl ketone), and an internal of the reaction vessel was replaced with nitrogen gas. The internal of the reaction vessel was heated to 80° C., and a mixture of raw material monomers as listed in Table 2 and a polymerization initiator was added dropwise thereto over 2 hours to carry out a polymerization reaction. After the termination of the dropwise addition, the reaction mixture was further reacted at 80° C. for 3 hours. The solvent was distilled off at 80° C., to provide a dispersant composed of a copolymer having physical properties shown in Table 2.

TABLE 2

| Dispersant | | Molecular Weight | Dispersant A | Dispersant B | Dispersant C | Dispersant D | Dispersant E | Dispersant F | Dispersant G | Dispersant H | Dispersant I |
|---|---|---|---|---|---|---|---|---|---|---|---|
| Raw Material Monomers | Dimethylaminoethyl methacrylate [DMAEMA], manufactured by Wako Pure Chemical Industries, Ltd. | 157.2 | 6.4 g | 20 g | 29.2 g | 38.2 g | 20 g | 20 g | 20 g | 6.4 g | 48.1 g |
| | 1-Dodecyl methacrylate [Lauryl methacrylate, LMA], manufactured by Wako Pure Chemical Industries, Ltd. | 254.4 | 93.6 g | 80 g | 70.8 g | 61.8 g | 72 g | — | — | 93.6 g | 51.9 g |
| | 1-Octadecyl methacrylate [Stearyl methacrylate, SMA], manufactured by Wako Pure Chemical Industries, Ltd. | 338.6 | — | — | — | — | — | — | 80 g | — | — |
| | 2-Ethylhexyl methacrylate [2-EHMA], manufactured by Wako Pure Chemical Industries, Ltd. | 198.3 | — | — | — | — | — | 80 g | — | — | — |
| | Butyl acrylate [BA], manufactured by Wako Pure Chemical Industries, Ltd. | 128.2 | — | — | — | — | 8 g | — | — | — | — |
| Polymerization-Initiator | 2,2'-Azobis(2,4-dimethylvaleronitrile), manufactured by Wako Pure Chemical Industries, Ltd. | — | 2 g | 3 g | 2.3 g | 2.4 g | 9 g | 3 g | 3 g | 8 g | 3 g |
| Physical Properties of Dispersant | Number-Average Molecular Weight | | 6,700 | 4,000 | 6,900 | 3,400 | 3,000 | 3,400 | 4,700 | 3,100 | 2,700 |
| | Weight-Average Molecular Weight | | 25,000 | 15,000 | 23,000 | 15,000 | 13,000 | 14,000 | 15,000 | 11,000 | 10,000 |

EXAMPLES 1 TO 7 AND COMPARATIVE EXAMPLES 1 TO 5

Eighty-five parts by mass of a resin binder as listed in Table 4 and 15 parts by mass of a pigment "ECB-301" manufactured by DAINICHISEIKA COLOR & CHEMICALS MFG. CO., LTD., Phthalocyanine Blue 15:3, were previously mixed with a 20-L Henschel mixer while stirring for 3 minutes at a rotational speed of 1,500 r/min (peripheral speed 21.6 m/sec), and the mixture was then melt-kneaded under the conditions given below.

[Melt-Kneading Conditions]

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a rotational speed of a high-rotation roller (front roller) of 75 r/min (peripheral speed 32.4 m/min), a rotational speed of a low-rotation roller (back roller) of 35 r/min (peripheral speed 15.0 m/min), and a gap between the rollers at an end of the raw material supplying side of 0.1 mm. The temperatures of the heating medium and the cooling medium inside the rollers were as follows. The high-rotation roller had a temperature at the raw material supplying side of 90° C., and a temperature at the kneaded product-discharging side of 85°

C., and the low-rotation roller had a temperature at the raw material supplying side of 35° C., and a temperature at the kneaded product-discharging side of 35° C. In addition, the feeding rate of the raw material mixture to the kneader was 10 kg/h, and the average residence time in the kneader was about 3 minutes.

The kneaded product obtained above was roll-cooled with a cooling roller, and the cooled product was then roughly pulverized with a hammer-mill to a size of 1 mm or so. The roughly pulverized product obtained was finely pulverized and classified with an air jet mill "IDS," manufactured by Nippon Pneumatic Mfg. Co., Ltd., to provide toner particles having a volume-median particle size $D_{50}$ of 10 μm.

A 1-L polyethylene vessel was charged with 35 parts by mass of the toner particles obtained, 61.5 parts by mass of an insulating liquid as listed in Table 4, and 3.5 parts by mass of a dispersant as listed in Table 4. The contents were stirred with "TX. ROBOMIX," manufactured by PRIMIX Corporation, under ice-cooling at a rotational speed of 7,000 r/min for 30 minutes, to provide a dispersion of toner particles having a solid content concentration of 38.5% by mass.

Next, the dispersion of toner particles obtained was subjected to wet-milling with 6 vessels-type sand grinder "TSG-6," manufactured by AIMEX CO., LTD., at a rotational speed of 1,300 r/min (peripheral speed 4.8 msec) using zirconia beads having a diameter of 0.8 mm at a volume filling ratio of 60% by volume, so as to give toner particles having a volume-median particle size $D_{50}$ as listed in Table 4. The beads were removed by filtration, and the insulating liquid as listed in Table 4 was added to the filtrate in an amount of 40 parts by mass based on 100 parts by mass of the filtrate to dilute, to provide a liquid developer having a solid content concentration of 26% by mass and having physical properties as shown in Table 4.

The details of the insulating liquids used in Examples and Comparative Examples are listed in Table 3.

TABLE 3

| Insulating Liquid | | | |
|---|---|---|---|
| Trade Name, Manufacturer | Chemical Name | Conductivity, S/m | Viscosity at 25° C., mPa · s |
| Exxsol D110, manufactured by Exxon Mobile Corporation | Naphthene Hydrocarbon | $1.69 \times 10^{-12}$ | 3 |
| IP Solvent 2028, manufactured by Idemitsu Kosan Co., Ltd. | Liquid Paraffin | $7.06 \times 10^{-13}$ | 2 |

TEST EXAMPLE 1 —Eluting Property of Resin Binder into Insulating Liquid

A resin binder used in a liquid developer was roughly pulverized with Rotoplex manufactured by Hosokawa Micron Corporation, and the roughly pulverized product obtained was finely pulverized and classified with an air jet mill "IDS" manufactured by Nippon Pneumatic Mfg. Co., Ltd., to provide fine resin particles having a volume-median particle size $D_{50}$ of 10 μm.

A 50-mL polyethylene vessel was charged with 3.75 g of the fine resin particles obtained and 11.25 g of an insulating liquid used in a liquid developer, and the contents were stirred at 7,000 r/min for 10 minutes under cooling water with T-25 digital ULTRA-TURRAX manufactured by IKA laboratory technology. Ten grams of the suspension after stirring was spinned at a rotational speed of 25,000 r/min for 1 hour with a centrifuge "3-30KS" manufactured by SIGMA. Four grams of the supernatant after centrifugation was collected, and dried with a vacuum dryer at 0.5 kPa and 100° C. for 8 hours, to evaluate the eluting properties of the resin binder into the insulating liquid from the mass of the residue after drying. The results are shown in Table 4. The more the numerical figure approximates 0, the lower the eluting property.

TEST EXAMPLE 2 —Storage Stability of Toner

A 20-mL glass sample vial "Vial with screw cap, No. 5," manufactured by Maruemu Corporation, was charged with 10 g of a liquid developer, and stored in a thermostat held at 40° C. for 24 hours. The volume particle size distribution of the toner particles before and after storage was measured in the same manner as the method for measuring a volume-median particle size of the above toner particles, and a proportion (% by volume) of particles having particle sizes of 10 μm or more was calculated from the volume particle size distribution obtained, to evaluate storage stability from a difference of the value before storage (X) from the value after storage (Y) (Y−X). The results are shown in Table 4. An increase in the proportion of the particles having particle sizes of 10 μm or more means that the generation of aggregation of toner particles due to storage is remarkable. The more the difference of before and after storage approximates 0, the more excellent the storage stability of the toner particles.

TEST EXAMPLE 3 —Low-Temperature Fusing Ability of Toner

A liquid developer was dropped on "POD Gloss Coated Paper" manufactured by Oji Paper Co., Ltd., and produced a thin film with a wire bar, so that the mass on a dry basis was 1.2 g/m$^2$.

The produced thin film was kept in a thermostat at 80° C. for 10 seconds, and thereafter fused at a fusing speed of 140 mm/sec, with an external fuser taken out of the fusing apparatus of "OKI MICROLINE 3010," manufactured by Oki Data Corporation, the fusing roller temperature being set at 90° C. Thereafter, the fusing roller temperature was set at 100° C., and the same procedures were carried out. The fusing treatment of unfused images was carried out at each temperature while raising the temperature up to 140° C. with an increment of 10° C. to provide fused images.

The fused images obtained were adhered to a mending tape "Scotch Mending Tape 810," manufactured by 3M, width of 18 mm, the tape was pressed with a roller so as to apply a load of 500 g thereto, and the tape was then removed. The optical densities before and after tape removal were measured with a colorimeter "GretagMacbeth Spectroeye," manufactured by Gretag. The fused image-printed portions were measured at 3 points each, and an average thereof was calculated as an optical density. A fusing ratio (%) was calculated from a value obtained by [optical density after removal]/[optical density before removal]×100, to evaluate low-temperature fusing ability where a fusing roller temperature at which a fusing ratio firstly reaches 90% or more is defined as a lowest fusing temperature. The results are shown in Table 4. The smaller the numerical values, the more excellent the low-temperature fusing ability, and the lowest fusing temperature is preferably 120° C. or lower, more preferably 110° C. or lower, and even more preferably 100° C. or lower.

TABLE 4

| | Liquid Developer | | | | | | | |
|---|---|---|---|---|---|---|---|---|
| | | | | Dispersant Composition (Upper Row:Mass Ratio, Lower Row:Molar Ratio) | | | | |
| | Resin Binder | Insulating Liquid | Dispersant | DMAEMA | LMA | SMA | 2-EHMA | BMA |
| Ex. 1 | Resin A | Exxsol D110 | Dispersant A | 6.4 (10) | 93.6 (90) | — | — | — |
| Ex. 2 | Resin A | Exxsol D110 | Dispersant B | 20 (28.8) | 80 (71.2) | — | — | — |
| Ex. 3 | Resin A | Exxsol D110 | Dispersant C | 29.2 (40) | 70.8 (60) | — | — | — |
| Ex. 4 | Resin A | Exxsol D110 | Dispersant D | 38.2 (50) | 61.8 (50) | — | — | — |
| Ex. 5 | Resin A | Exxsol D110 | Dispersant G | 20 (35) | — | 80 (65) | — | — |
| Ex. 6 | Resin A | IP Solvent 2028 | Dispersant A | 6.4 (10) | 93.6 (90) | — | — | — |
| Ex. 7 | Resin A | Exxsol D110 | Dispersant H | 6.4 (10) | 93.6 (90) | — | — | — |
| Comp. Ex. 1 | Resin A | Exxsol D110 | Dispersant E | 20 (26.9) | 72 (59.9) | — | — | 8 (13.2) |
| Comp. Ex. 2 | Resin A | Exxsol D110 | Dispersant F | 20 (24) | — | — | 80 (76) | — |
| Comp. Ex. 3 | Resin B | Exxsol D110 | Dispersant A | 6.4 (10) | 93.6 (90) | — | — | — |
| Comp. Ex. 4 | Resin C | Exxsol D110 | Dispersant A | 6.4 (10) | 93.6 (90) | — | — | — |
| Comp. Ex. 5 | Resin A | Exxsol D110 | Dispersant I | 48.1 (60) | 51.9 (40) | — | — | — |

| | Liquid Developer | | Eluting | | | | |
|---|---|---|---|---|---|---|---|
| | $D_{50}$ of Toner | | Property of Resin Binder | Storage Stability | | | Low-Temp. Fusing Ability |
| | Particles, μm | Viscosity, mPa · s | Mass of Residue, mg | Before Storage X | After Storage Y | Y-X | Lowest Fusing Temp., ° C. |
| Ex. 1 | 2.3 | 8 | 0 | 0 | 0 | 0 | 100 |
| Ex. 2 | 2.3 | 10 | 0 | 0 | 0 | 0 | 100 |
| Ex. 3 | 2.3 | 11 | 0 | 0 | 0 | 0 | 120 |
| Ex. 4 | 2.6 | 15 | 0 | 0 | 0 | 0 | 120 |
| Ex. 5 | 2.3 | 9 | 0 | 0 | 0 | 0 | 120 |
| Ex. 6 | 2.3 | 10 | 0 | 0 | 0 | 0 | 100 |
| Ex. 7 | 2.5 | 16 | 0 | 0 | 0 | 0 | 110 |
| Comp. Ex. 1 | 4.2 | 33 | 0 | 4 | 13 | 9 | 120 |
| Comp. Ex. 2 | 4.3 | 18 | 0 | 4 | 15 | 11 | 120 |
| Comp. Ex. 3 | 2.4 | 11 | 5 | 0 | 0 | 0 | 100 |
| Comp. Ex. 4 | 2.3 | 10 | 3 | 0 | 0 | 0 | 100 |
| Comp. Ex. 5 | 3.5 | 27 | 0 | 1 | 5 | 4 | 130 |

It can be seen that the toners of Examples 1 to 7 are excellent in all of control of elution of the resin binder, formation of smaller particle sizes of the toner particles, and lowered viscosity, storage stability, and low-temperature fusing ability of the liquid developer, as compared to the toners of Comparative Examples 1 to 5.

It can be seen from the comparisons of Examples 1 to 4 with Comparative Example 5 that the toner of Example 1 containing a copolymer having a monomer A/monomer B molar ratio of 10/90 is more excellent in formation of smaller particle sizes of the toner particles and lowered viscosity, storage stability, and low-temperature fusing ability of the liquid developer.

It can be seen from the comparisons of Example 1, Example 5 and Comparative Example 2 that the toner of Example 1 containing a copolymer in which an alkyl (meth) acrylate having an alkyl group having 12 carbon atoms is used as a monomer B is more excellent in formation of smaller particle sizes of the toner particles and lowered viscosity, storage stability, and low-temperature fusing ability of the liquid developer.

It can be seen from the comparisons of Example 1 with Comparative Examples 3 and 4 that the toner of Example 1 containing a polyester resin in which 100% by mol of an aliphatic diol having from 2 to 6 carbon atoms is used as an alcohol component is excellent in control of elution of the resin binder and lowered viscosity of the liquid developer.

It can be seen from the comparison of Example 1 with Comparative Example 1 that the toner of Example 1 containing a copolymer having a monomer B 1/monomer B2 molar ratio of 0 is more excellent in formation of smaller particle sizes of the toner particles and lowered viscosity, storage stability, and low-temperature fusing ability of the liquid developer.

It can be seen from the comparison of Example 1 with Example 7 that the toner of Example 1 containing a copolymer having a weight-average molecular weight of 25,000 is more excellent in lowered viscosity and low-temperature fusing ability.

The liquid developer of the present invention is suitably used in development or the like of latent images formed in electrophotography, electrostatic recording method, electrostatic printing method or the like.

The invention claimed is:

1. A liquid developer comprising toner particles comprising a resin binder and a pigment, wherein the toner particles are dispersed in an insulating liquid in the presence of a dispersant, wherein the resin binder comprises a polyester resin P having a glass transition temperature of 35° C. or higher, obtained by polycondensing raw material monomers comprising an alcohol component comprising an aliphatic diol having 2 to 6 carbon atoms in an amount of 70% to 100% by mol, and a carboxylic acid component, and wherein the dispersant comprises a copolymer C prepared by polymerizing a monomer A having an amino group and a monomer B represented by the formula (I):

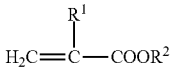

(I)

wherein $R^1$ is a hydrogen atom or a methyl group; and $R^2$ is an alkyl group having 1 to 22 carbon atoms or an alkenyl group having 2 to 22 carbon atoms, each of which may have a substituent, wherein a molar ratio of the monomer A to the monomer B (monomer A/monomer B) is in a range of 2/98 to 50/50, and a molar ratio of a monomer B1 in which $R^2$ in the monomer B is an alkyl group having 1 to 9 carbon atoms or an alkenyl group having 2 to 9 carbon atoms to a monomer B2 in which $R^2$ in the monomer B is an alkyl group or alkenyl group having 10 to 22 carbon atoms (monomer B1/monomer B2) is in a range of 0 to 0.1.

2. The liquid developer according to claim 1, wherein the weight-average molecular weight of the copolymer C is 5,000 to 100,000.

3. The liquid developer according to claim 1, wherein the aliphatic diol having 2 to 6 carbon atoms is an aliphatic diol having a hydroxyl group bonded to a secondary carbon atom, and wherein the polyester resin P is a polyester resin obtained by polycondensing an alcohol component comprising 80% by mol or more of an aliphatic dial having a hydroxyl group bonded to a secondary carbon atom and a carboxylic acid component.

4. The liquid developer according to claim 1, wherein the content of the copolymer C is 1 part by mass to 25 parts by mass based on 100 parts by mass of the polyester resin P.

5. The liquid developer according to claim 1, wherein the polyester resin P is a resin comprising 60% by mass or more of polyester units.

6. The liquid developer according to claim 1, wherein the insulating liquid comprises a hydrocarbon solvent.

7. The liquid developer according to claim 1, wherein the carboxylic acid component of the polyester resin P comprises an aromatic dicarboxylic acid compound.

8. The liquid developer according to claim 7, wherein the content of the aromatic dicarboxylic acid compound is 50% by mol or more of the carboxylic acid component.

9. The liquid developer according to claim 1, wherein the softening point of the polyester resin P is 75° C. to 120° C.

10. A method for producing a liquid developer, comprising:

melt-kneading at least a resin binder and a pigment, and pulverizing a kneaded product obtained, to obtain toner particles; and dispersing said toner particles in an insulating liquid in the presence of a dispersant, wherein the resin binder comprises a polyester resin P having a glass transition temperature of 35° C. or higher, obtained by polycondensing raw material monomers comprising an alcohol component comprising an aliphatic diol having 2 to 6 carbon atoms in an amount of 70% to 100% by mol, and a carboxylic acid component, and wherein the dispersant comprises a copolymer C prepared by polymerizing a monomer A having an amino group and a monomer B represented by the formula (I):

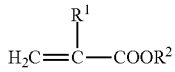

(I)

wherein $R^1$ is a hydrogen atom or a methyl group; and $R^2$ is an alkyl group having 1 to 22 carbon atoms or an alkenyl group having 2 to 22 carbon atoms, each of which may have a substituent, wherein a molar ratio of the monomer A to the monomer B (monomer A/monomer B) is in a range of 2/98 to 50/50, and a molar ratio of a monomer B1 in which $R^2$ in the monomer B is an alkyl group having 1 to 9 carbon atoms or an alkenyl group having 2 to 9 carbon atoms to a monomer B2 in which $R^2$ in the monomer B is an alkyl group or alkenyl group having 10 to 22 carbon atoms (monomer B1/monomer B2) is in a range of 0 to 0.1.

11. The liquid developer according to claim 1, wherein the monomer A having an amino group is at least one member selected from the group consisting of:

(i) a monomer having an amino group represented by the formula (II):

$$CH_2{=}C(R^5)COYR^6NR^3R^4 \quad \text{(II)}$$

wherein each of $R^3$ and $R^4$ is independently a hydrogen atom, or a linear or branched alkyl group having 1 to 4 carbon atoms, which may be bonded to each other to form a ring structure; $R^5$ is a hydrogen atom or a methyl group; $R^6$ is a linear or branched alkylene group having 2 to 4 carbon atoms, and Y is —O— or —NH—, (ii) an acid neutralized product of the monomer (i), and (iii) a quaternary ammonium salt of the monomer (i).

12. The liquid developer according to claim 1, wherein the acid value of the polyester resin P is 1 to 20 mgKOH/g.

13. The method for producing a liquid developer according to claim 10, wherein the dispersing comprises:

adding a dispersant to the toner particles to disperse in an insulating liquid to obtain a dispersion of the toner particles; and subjecting the dispersion of the toner particles to wet-milling, to obtain a liquid developer.

14. The method for producing a liquid developer according to claim 10, wherein the monomer A having an amino group is at least one member selected from the group consisting of:

(i) a monomer having an amino group represented by the formula (II):

$$CH_2{=}C(R^5)COYR^6NR^3R^4 \quad (II)$$

wherein each of $R^3$ and $R^4$ is independently a hydrogen atom, or a linear or branched alkyl group having 1 to 4 carbon atoms, which may be bonded to each other to form a ring structure; $R^5$ is a hydrogen atom or a methyl group; $R^6$ is a linear or branched alkylene group having 2 to 4 carbon atoms, and Y is —O— or —NH—, (ii) an acid neutralized product of the monomer (i), and (iii) a quaternary ammonium salt of the monomer (i).

15. The method for producing a liquid developer according to claim 10, wherein the weight-average molecular weight of the copolymer C is 5,000 to 100,000.

16. The method for producing a liquid developer according to claim 10, wherein the aliphatic diol having 2 to 6 carbon atoms is an aliphatic diol having a hydroxyl group bonded to a secondary carbon atom, and wherein the polyester resin P is a polyester resin obtained by polycondensing an alcohol component comprising 80% by mol or more of an aliphatic diol having a hydroxyl group bonded to a secondary carbon atom and a carboxylic acid component.

* * * * *